US005725098A

United States Patent [19]

Seifert et al.

[11] Patent Number: 5,725,098

[45] Date of Patent: Mar. 10, 1998

[54] PORTABLE, FOLDING RECEPTACLE OR BOX WALLET FORM MADE FROM A PLASTIC MATERIAL

[75] Inventors: Josef Seifert, Grosselfingen; Josef Kurz, Haigerloch 3-Owingen, both of Germany

[73] Assignee: Kurz Kunststoffe GmbH, Haigerloch, Germany

[21] Appl. No.: 324,137

[22] Filed: Oct. 17, 1994

Related U.S. Application Data

[63] Continuation of Ser. No. 890,570, May 28, 1992, abandoned.

[51] Int. Cl.[6] ..... A45C 11/00

[52] U.S. Cl. ..... 206/472; 206/37; 220/4.23; 220/339

[58] Field of Search ..... 206/214, 224, 206/232, 38, 234, 371, 37, 450, 472, 473, 474, 475, 39; 220/334, 336, 337, 339, 4.21, 4.22, 4.23

[56] References Cited

U.S. PATENT DOCUMENTS

| | | | |
|---|---|---|---|
| 2,194,003 | 3/1940 | Brooks | 206/214 X |
| 3,126,891 | 3/1964 | Caputi | 206/214 X |
| 4,588,321 | 5/1986 | Egly | 206/425 X |
| 4,890,728 | 1/1990 | Grimsley | 206/472 X |
| 4,896,787 | 1/1990 | Delamour et al. | 220/339 |
| 4,966,283 | 10/1990 | Sykes et al. | 206/472 X |
| 5,005,721 | 4/1991 | Jordan | 220/339 X |
| 5,036,973 | 8/1991 | Aida | 206/214 |
| 5,121,834 | 6/1992 | Tissembeaum | 220/339 X |
| 5,145,068 | 9/1992 | Schmitz et al. | 206/472 |

*Primary Examiner*—Jacob K. Ackun

*Attorney, Agent, or Firm*—Darby & Darby

[57] ABSTRACT

In connection with a portable folding receptacle of wallet format, made from a plastic material and being especially suited as multi-purpose portfolio, it is proposed to connect two half-shells by means of an elastic, integrally formed back hinge comprising longitudinally extending ridges with interposed film-joint hinge elements permitting smooth opening and closing of the receptacle. The receptacle may be equipped with folding inserts, in the manner of a book, or may be equipped in its interior with a ring-book mechanism.

9 Claims, 4 Drawing Sheets

Fig. 5
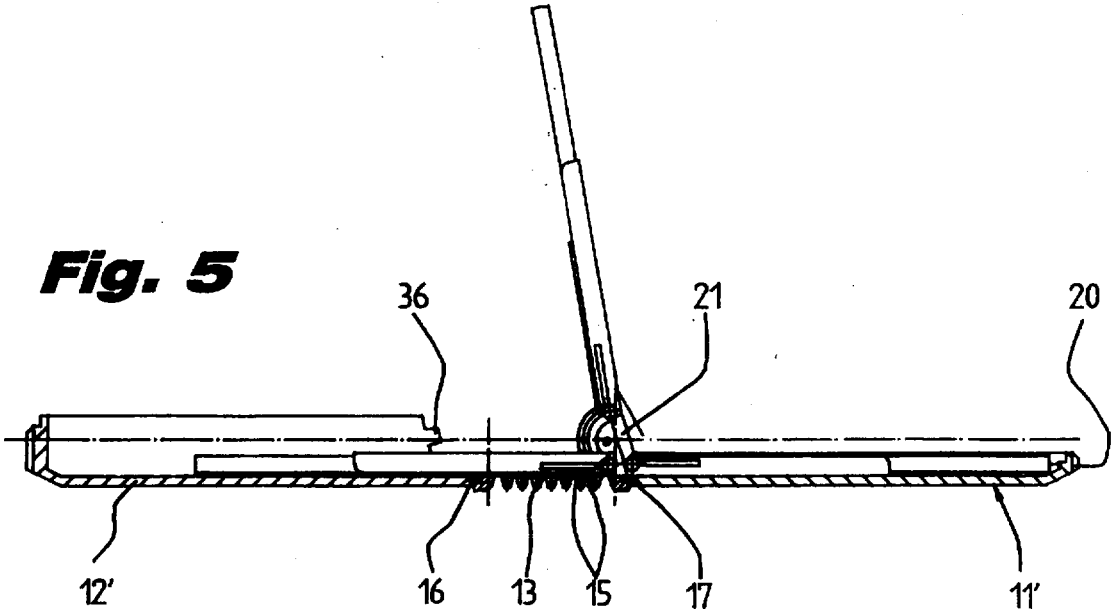
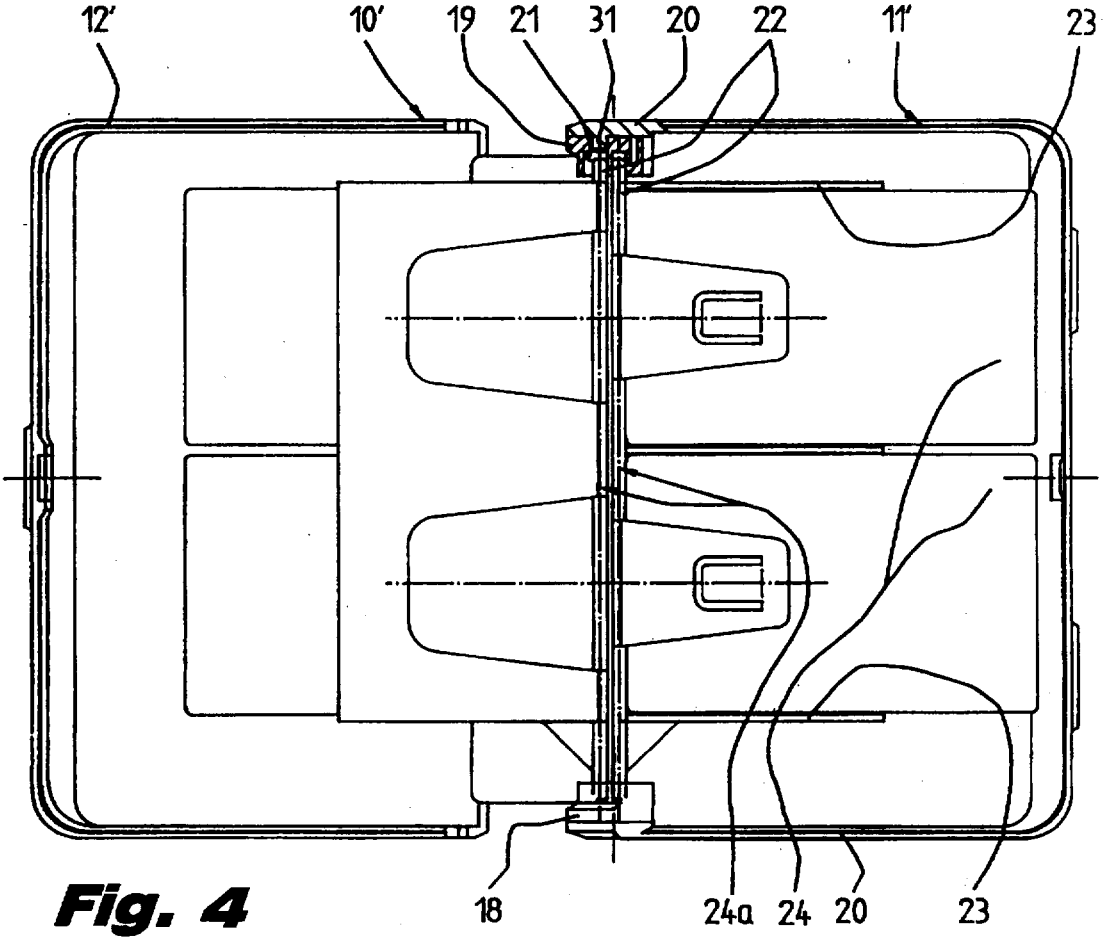
Fig. 4

PORTABLE, FOLDING RECEPTACLE OR BOX WALLET FORM MADE FROM A PLASTIC MATERIAL

This patent application is a continuation of application Ser. No. 07/890,570 filed May 28, 1992, now abandoned.

BACKGROUND OF THE INVENTION

The invention relates to a portable folding receptacle.

In modern life there is frequently a need for a stiff container intended for accommodating arbitrary objects which, while having small dimensions so that it can be carried in a coat pocket, should be suited for accommodating the most diverse things safely and protected from pressure.

It is, therefore, the object of the present invention to provide a portable, folding receptacle or a box having substantially the format of a wallet and made of a stiff, strong plastic material, which provides in its interior sufficient space for accommodating a plurality of objects, sheets, visiting cards, fine tools, storage cards or diskettes for computers, diaries, notebooks, or the like, and which, while presenting high resistance and a simple structure, can be produced at low cost.

The invention achieves this object and offers the advantage that it provides a universally applicable receptacle capable of receiving a plurality of objects in a safe way, and protected from pressure, the particular mechanism of the interconnected half-shells constituting the receptacle providing in addition largely dust-free-storage conditions.

Another advantage of the invention is seen in the fact that the flat, robust receptacle, which resembles a wallet, presents an elegant, attractive shape and can be safely closed by snap means provided on its two half-shells, it being additionally possible to design adjacent marginal edges in such a way as to form sort of an interlocking labyrinth seal.

The easy use and tightness of the receptacle so created are further supported by a particularly elastic and adaptable hinge provided on its back and including, in the longitudinal direction, grooves extending in parallel to each other, i.e. being separated by longitudinal ridges, so that the material of the back hinge is reduced to residual film-like webs providing on the one hand high rigidity in the longitudinal direction and correspondingly high flexibility and resilience of the back hinge in the transverse direction. Thus, the two half-shells forming the receptacle are interconnected safely and in a fatigue-resisting way and so that the individual film joints of the hinge at the back are subjected to little stress, since even in the completely open condition of the two-half-shells, i.e. when the maximum opening angle of 180° is reached, the individual film joints in the connection or hinge at the back will be subjected only to reduced variations of their angular position which latter is determined by dividing the total angle by the total number of existing film joints and, thus, longitudinal webs.

In addition, the elastic back hinge forms a perfect transition between the half-shells, interconnecting the outer surfaces of the receptacle across the back hinge, which interconnects the two half-shells, by a smooth bend.

According to a particularly advantageous embodiment of the invention, the wallet-like receptacle is designed as a two-component part, where the two half-shells interconnected by the back hinge are made of a correspondingly hard, elegantly structured material, while a second, softer plastic material is used for the back hinge, in which case the connection of the two materials may be implemented by usual injection-molding techniques. It is possible in this case, for example, to produce at first the two half-shells and to mold the back hinge thereon subsequently, in which case a safe connection of the materials can be achieved by providing oblong holes in the neighboring edges of the half-shells, and covering up these holes during the molding process.

Such a portable and folding plastic receptacle can solve a plurality of transport and storage problems, and this not only due to its capability of protecting its content from shocks and pressure, but also due to the space provided in its interior which remains invariable and which, therefore, enables even delicate objects to be stored and transported in such receptacles.

The receptacle according to the invention, therefore, is particularly well suited for storing and transporting storage cards or diskettes for computers, including for example so-called RAM cards or storage cards, and further, when (additional) deep-drawn shells with suitably shaped recesses are used, which may be additionally lined with a suitable soft material, for accommodating and storing valuable small things, including jewelry and precious stones. Finally, it is also possible to accommodate diary sheets, notebooks, or suitable plastic pockets by means of a ring mechanism which can also be fastened in the receptacle, for receiving credit cards, visiting cards, other identity cards, or the like, or for accommodating stamps or coins, which are then received in special inserts.

In fact, the plastic box according to the invention is suited for practically unlimited applications, especially because any desired system of inserts can be fitted by means of a suitable, versatile mounting mechanism.

The features specified in the dependent claims permit advantageous further developments and improvements of the invention. A particularly advantageous solution is seen in the arrangement of special mounting blocks on both ends of the hinge area of the receptacle, which then form end supports for any type of folding insert system.

BRIEF DESCRIPTION OF THE DRAWINGS

The drawing shows certain embodiments of the invention which will be described hereafter in more detail. In the drawing:

FIG. 2 shows an elevation of the plastic box according to FIG. 1, viewed from the front, opposite the back hinge, while;

FIGS. 4, 5 and 6 show—in this order—an embodiment of plastic box which is especially suited for receiving and for clamping disk-like or card-like smaller objects, in open condition and viewed from above, a partly sectional side view and a sectional view with the box in closed condition;

DESCRIPTION OF THE EMBODIMENTS OF THE INVENTION

The basic idea of the invention is to interconnect two plastic half-shells on one side by an elastic rolling hinge and to equip the interior of at least one of the plastic shells with mounting blocks for insert systems or deep-drawn inserts with receiving pockets.

Figure 1:
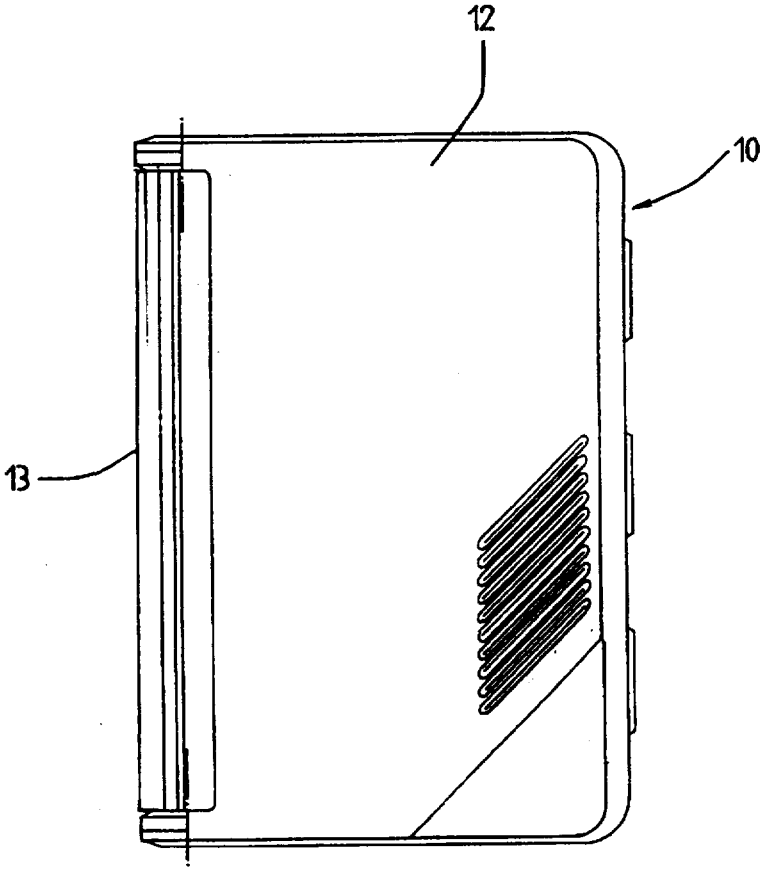
FIG. 1 shows a top view of an embodiment of a closed wallet-like receptacle consisting of a plastic material and comprising an elastic back hinge.
Figure 7:
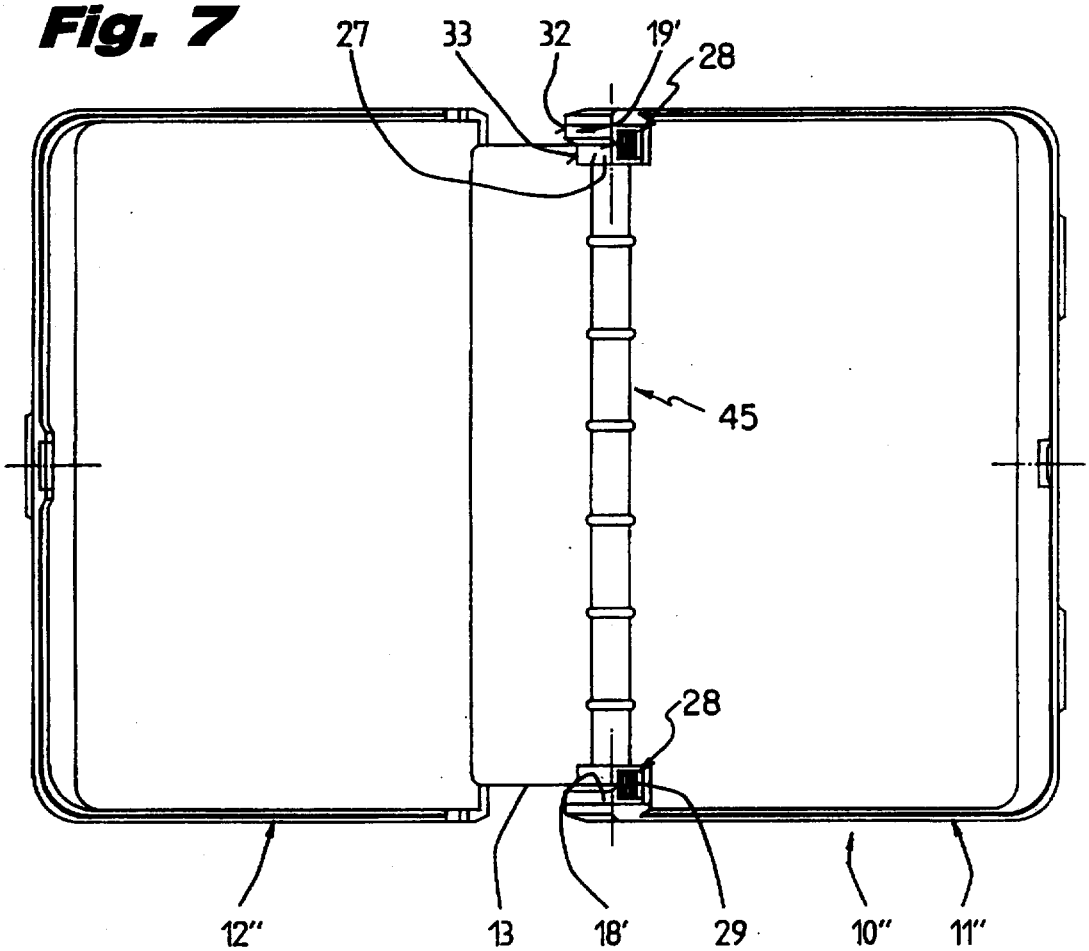

As can be seen, for example in FIGS. 4 and 7, the plastic receptacle 10 (FIG. 1) or 10' (FIG. 4) or 10" (FIG. 7) consists of two half-shells 11 and 12, or 11', 12'; 11", 12", which may be identical one to the other, but may advantageously differ one from the other at least by the height of the marginal edges extending perpendicular to the bottom, and which are made from a suitable rigid plastic material, for example by injection molding, or the like.

The half-shells are interconnected by a back hinge 13, which likewise consists of a plastic material, preferably one different from the plastic material of the half-shells 11 and 12, so that the receptacle as a whole constitutes a two-component part, providing particular strength and stability in the area of the half-shells and elastically yielding properties in the area of the back hinge interconnecting the two half-shells, which enables the half-shells to be opened and closed without any difficulty, and without a spring-back resilience tending to return the opened plastic shells to their closed position, which is normally encountered with certain plastic materials.

Although it is understood that it is well within the scope of the present invention to make the whole plastic receptacle from a single material or substance, i.e. to mold the half-shells and their interconnecting back hinge as a single part, such a solution may lead to a compromise resulting in too soft a material for the half-shells and too hard a material for the back hinge.

Preferably, manufacture therefore proceeds in such a way that in a first step, the half-shells are produced by a suitable injection-molding technique, and the hinge is molded on later using a different, softer material which is particularly well suited for constituting such a hinge.

Figure 6:
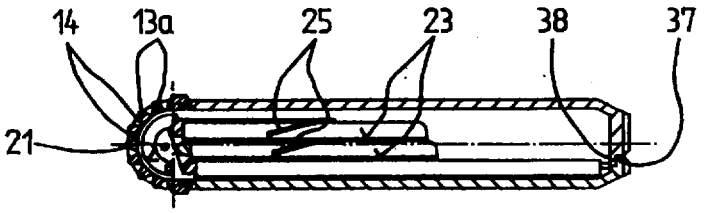
Figure 9:
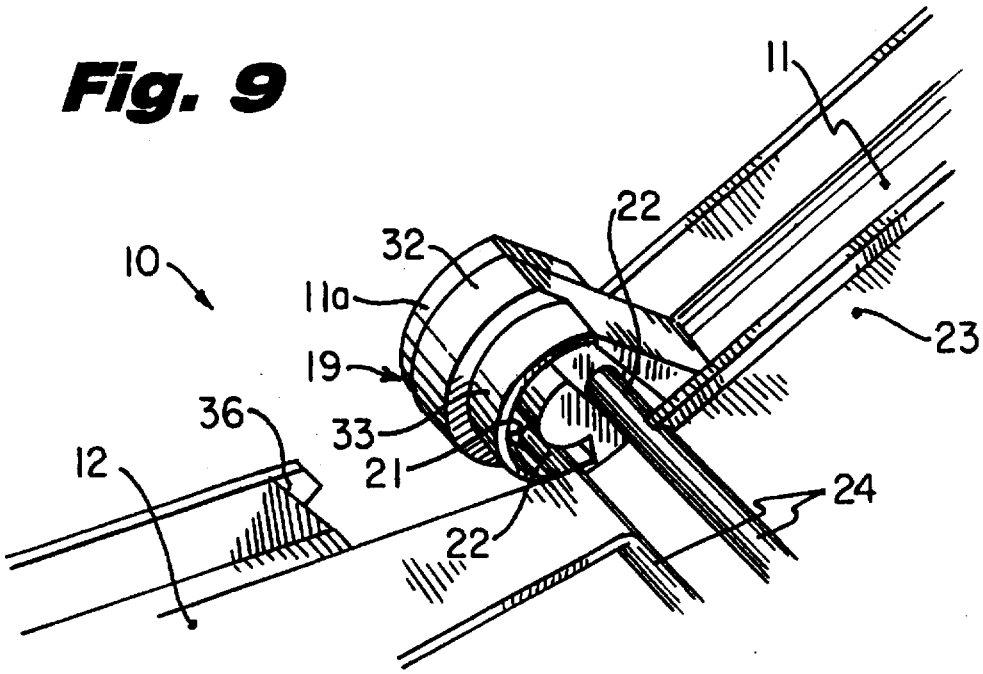
FIG. 9 is a fragmentary perspective view, on an enlarged scale, showing the upper central portion of the box of FIG. 4.

As can be seen more clearly in FIGS. 5 and 6, the integrally formed back hinge consists of a series of longitudinal ridges 13*a*, separated by what may be regarded as grooves or furrows 14 extending in parallel to the ridges. The base walls of the furrows are then cut down until, as can be seen best in FIGS. 5 and 8, connections 15 similar to film joints are obtained between the individual longitudinal ridges 13*a*, which connections are then responsible for the elasticity and resilience of the back hinge in transverse direction, thus facilitating the opening and closing movements of the receptacle, whereas good stability is maintained in the longitudinal direction thanks to the ridges 13*a*, which essentially forms solid ribs.

Such a back hinge consisting of a suitable second soft material provides special advantages with respect to the handling of the receptacle and is connected with the two adjacent bottom edges 16 and 17 of the half-shells in form-locking relationship, being molded thereon, it being further possible to provide the marginal edges with embossed patterns or even holes, for example in the form of oblong holes, in which case an intimate connection is achieved by the material of the film joint entering the resulting recesses during the molding-on process.

Preferably, the back hinge comprises more than one such partial film joints 15, separated by ridges. To express it in numerical values, the illustrated embodiment in fact comprises eight partial film joints 15 so that during opening or closing of the receptacle over a total of 180° each of the film joints will be subjected to an angular opening movement of merely 22°, for example. This, together with a suitable selection of the material to be used, ensures extended durability for the back hinge.

Another advantage of such a back hinge design lies in the fact that it is now possible to give the receptacle not only an attractive appearance and improved carrying and handling properties, but in addition special tightness and stability in the closed condition, in spite of the resilience of the back hinge—a fact which will be discussed in more detail further below and which is due mainly to the circumstance that during the closing operation the two ends of the back hinge follow, and apply themselves against, a uniform curve.

Prior to regarding this aspect more closely, it should be noted that with a view to making the receptacle suitable for receiving objects of any kind, the receptacle may be designed in the form of a book, as illustrated for two embodiments. To this end, both embodiments have one of the half-shells provided with supporting or mounting blocks in the area of the back hinge.

Regarding initially the embodiment according to FIG. 4, one can see that these mounting blocks 18, 19 provided on both ends have been injection-molded as separate parts and are detachably connected, in the illustrated embodiment, to the outer end of the marginal edge of the receptacle 10 extending around the full circumference of the lower half-shell 11, 11', 11", except in the area of the back hinge.

With the receptacle in the open condition, in which it resembles a book, the oppositely arranged mounting blocks 18, 19 are located at about the middle of the receptacle and, more exactly, as shown in FIG. 5, above the transition zone between the lower half-shell 11, 11', 11" and the back hinge.

In the case of the embodiment of the invention illustrated in FIGS. 4, 5, 6, and 9, a number of flat receiving envelops are fitted in the mounting blocks 18, 19 in folding relationship for which purpose the mounting blocks exhibit on their insides an annular groove 21 extending at least over a semicircle from the bottom to the top and back again to the bottom of mounting blocks 18 and 19, the groove 21 being sufficiently wide to accept a plurality of ends 22 of mounting ridges 24. The mounting arrangements projecting from these mounting ridges 24, and resembling the pages of a book, may be designed in any way. In the case of the embodiment illustrated in FIGS. 4, 5, 6 and 9, they take the form of pockets 23 for receiving small parts, for example the before-mentioned RAM cards or diskettes or other substantially flat parts which can be introduced into the pocket (FIG. 4, FIG. 6) and are than clamped therein by means of resilient straps 25 which are bent off in downward direction.

When a plastic container of this design is opened, the individual inserts so formed can be turned over one by one. FIG. 5 shows one of the inserts in the raised position, the ends of the mounting ridges of each insert being arranged to slide and to be displaced in the guiding grooves 21 provided on both sides in the supporting or mounting blocks 18, 19.

It is understood that this way of mounting inserts enables the latter to be designed in a great variety of variants, which creates the possibility to fit many different sheets comprising different pockets suited for receiving, for example, coins, stamps, or credit cards, visiting cards, or the like.

Figure 8:
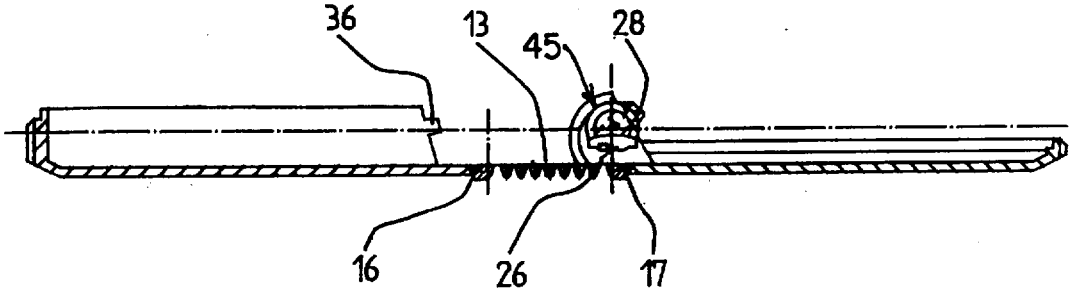
FIGS. 7 and 8 show a top view and a partly sectional view of a second embodiment of a plastic box with ring-book mechanism, with the box in open condition.
Figure 10:
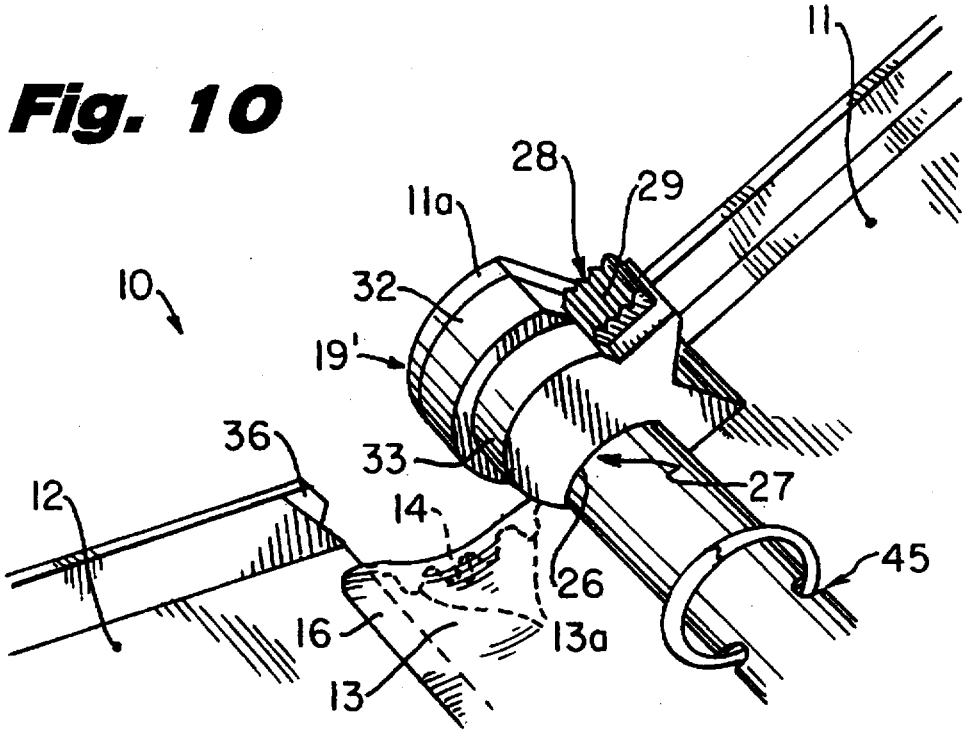
FIG. 10 is a fragmentary perspective view, on an enlarged scale, showing the upper central portion of the box of FIG. 7.

According to a variant of the present invention, it is provided that instead of mounting separate inserts, each held in axial stubs on both ends, a conventional ring-book structure comprising a ring mechanism 45 is received in the supporting or mounting blocks 18', 19' on both ends, as illustrated in FIGS. 7, 8 and 10. Such a ring mechanism 45 being known as such, its structure and function need not be discussed here in detail; it could also be imagined to use such a ring mechanism 45 in addition to the inserts, in which case it may be accommodated, for example, in the other half-shell.

The two mounting blocks 18', 19' are designed in this case in such a way that the terminal portion 27 (FIGS. 7, 8 and 10) of the ring mechanism 45 is inserted, free from any tilting play, into receiving openings 26 in each of the mounting blocks 18', 19'. Each of the mounting blocks 18', 19' additionally has an actuating slide 28 arranged to slide in longitudinal direction in the mounting block and comprising, for example, a corrugated surface 29 which is accessible from the outside. The lower part of the slide 28 includes a projection 40 which serves to assert pressure upon flat pressure surface 41 of the ring mechanism 45. It is thus possible, in addition to the retaining function of the mounting blocks 18', 19' provided on both sides, to open the ring mechanism 45 by operation of the actuating slide 28 so as to enable arbitrary sheets to be introduced or removed.

It is understood that for applying the insert or the ring mechanism in the case of the illustrated embodiments of the invention, one initially mounts the installation or mounting mechanism to be used in the receptacle, fixing it in the mounting blocks, with the latter still in disassembled condition, whereafter the mounting blocks, 18, 19; 18', 19' are connected with the inner surfaces of the edges of the respective half-shell by inserting them in a suitable manner and locking them in place.

The representation of FIG. 4 illustrates a suitable, mushroom-shaped locking button 31 formed integrally with the marginal edge of the half-shell and serving as form-locking mounting and fixing means for the mounting blocks 18, 19 . . . , which are engaged with the surfaces of the marginal edges.

There is another feature which should be noted with respect to FIG. 7. The peripheral shape of the mounting block 18 and 19 is such that they comprise a first outer semi-circular surface 32 and a second inner semi-circular surface 33. Surface 33 having a somewhat reduced diameter. The first outer circular surface 32 ends flush with the corresponding circular shape of the end of the marginal edge of the—in this case—lower half-shell 11, 11', 11" (see in this connection dash line in the overall representation of a FIG. 7). The inner circular surface 33 defines a contact surface against which the back hinge 13 rolls and which, in the closed condition, gives the hinge its attractive, rearwardly rounded shape as illustrated in FIGS. 3 and 6.

Figure 3:
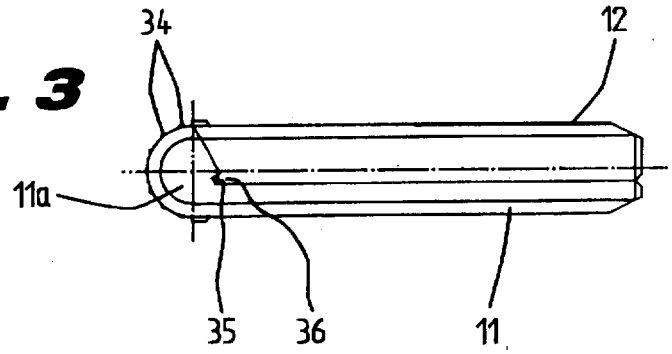
FIG. 3 shows a side view of the plastic box according to FIG. 1, illustrating also the arrangement of the elastic back hinge.
Figure 2:
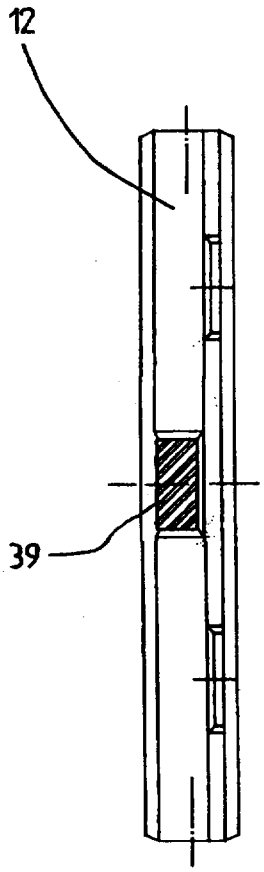

It can be further seen in FIG. 3 that due to the recessed circular surface 33 of each mounting block, the back hinge ends practically flush with the outer dimensions of the two half-shells when folded together, with only the points 34 of the ridges projecting slightly in upward direction. It can be further seen in FIG. 3 that while the marginal edge extending around the lower half-shell 11, 11', 11" has a somewhat lesser height, it is raised in semicircular form in the rear area where it is in contact with the back hinge, so as to form an upward extension 11*a*, which has been mentioned before as terminal area of the marginal edge and whose inner surface may serve to fix the internal mounting blocks 18, 19, 18', 19'. The described semicircular projection is additionally provided, on its side facing away from the back hinge, with a recess 35 which is engaged, in the closed condition, by a hook 36 formed by a projection of the higher marginal edge of the upper shell 12, 12', 12", whereby the two half-shells are connected firmly and safely, in spite of the elasticity of the back hinge. The connection is further supported by locking means provided in the front area which—as illustrated in FIG. 6—may consist of a hook 37 in the edge of the lower half-shell, engaging a recess 38 in the edge of the upper half-shell, or vice versa. According to FIG. 2, the upper half-shell 12, therefore, comprises a central pressure surface 39, pressing of which will help disengage the connection between the half-shells realized by the projection 37 and the recess 38.

Finally it should be noted that the claims, and in particular the main claim, are to be understood as attempts at formulating the invention, without thorough knowledge of the state of the art, and are not meant in any way to restrict the scope of the invention. Consequently, the right to regard all of the features described in the specification and the claims, and illustrated in the drawing, as essential to the invention and to specify them in the claims either individually or in any combination, or to reduce the features of the main claim, is herewith reserved.

What is claimed:

1. A portable, folding receptacle or box comprising:

two cover elements, each of said cover elements having a front marginal edge, a rear marginal edge a first side marginal edge and a second side marginal edge, said first side, second side, and front marginal edges of both of said cover elements including an integrally formed marginal wall, said marginal walls being formed vertically from a horizontal plane of each of said cover elements, the two marginal walls engaging each other in the closed condition of the receptacle by means of projections and recesses, the marginal walls of the first and second side marginal edges of one cover element being terminated at their rear ends by said projections, said projections being semicircular in shape;

mounting blocks mounted to inner surfaces of said protections;

an elastic single-piece back hinge interconnecting the two cover elements at said rear marginal edges, said back hinge comprising a plurality of alternating ridges forming solid ribs and grooves extending parallel to said rear marginal edges, said grooves having base walls extending between pairs of ridges which are of substantially reduced thickness compared to the ridges' extension in a direction generally perpendicular to an adjacent base wall, thereby forming a film-joint hinge.

2. A portable, folding receptacle according to claim 1, wherein one of the cover elements contains two mounting blocks for supporting inserts received in said receptacle, said two mounting blocks being positioned at the intersection of said rear marginal edge and said respective first and second side marginal edges of said one cover element.

3. A portable, folding receptacle according to claim 1, wherein the cover elements and the back hinge consist of different plastic materials, the plastic material of the back hinge being soft and flexible.

4. A portable, folding receptacle according to claim 1, wherein the mounting blocks are provided with an inwardly open annular groove.

5. A portable, folding receptacle according to claim 2, wherein the mounting blocks are provided on both sides with recesses for receiving a ring-book mechanism, each of said mounting blocks additionally having actuating slides which, when pressed manually, act to open the ring-book mechanism.

6. A portable, folding receptacle according to claim 1, wherein the back hinge is formed integrally with the rear marginal edges of the two cover elements, by molding said back hinge on said rear marginal edges.

7. A portable, folding receptacle according to claim 2, wherein the mounting blocks include a recessed annular surface, with which an inner surface of the back hinge are in intimate rolling contact during closing of the receptacle.

8. A portable, folding receptacle according to the claim 1 wherein said projections are provided on the marginal walls of said first and second side marginal edges of said one cover element in the hinge area;

said recesses are provided in the marginal walls of the first and second side marginal edges of the other cover element;

said projections and said recesses engage in the closed condition of said receptacle.

9. A portable, folding receptacle according to claim 4 further comprising inserts which are slidably mounted in said annular grooves of said mounting blocks, said inserts are provided with pockets, for receiving flat objects.

* * * * *